US006364734B1

(12) United States Patent
Ng

(10) Patent No.: US 6,364,734 B1
(45) Date of Patent: Apr. 2, 2002

(54) TOY TOP STRUCTURE AND SYSTEM

(76) Inventor: Ricky Ng, Hody Commercial Building, 3rd Floor, 6-6A Hart Avenue, Tsim Sha Tsui (HK)

( * ) Notice: Subject to any disclaimer, the term of this patent is extended or adjusted under 35 U.S.C. 154(b) by 0 days.

(21) Appl. No.: 09/550,063

(22) Filed: Apr. 14, 2000

(51) Int. Cl.[7] ..... A63H 1/00
(52) U.S. Cl. ..... 446/236; 446/260
(58) Field of Search ..... 446/236, 242, 446/256, 257, 258, 259, 260; 434/302

(56) References Cited

U.S. PATENT DOCUMENTS 547,764 A * 10/1895 Biyum
1,680,423 A * 8/1928 Lindstrom
1,780,547 A * 11/1930 Alland
1,783,627 A * 12/1930 Raimondi
2,481,337 A * 9/1949 Palken et al.
2,611,995 A * 9/1952 Krapp
2,631,405 A * 3/1953 Masten
3,803,757 A * 4/1974 Sanchez
3,879,887 A * 4/1975 Brookson
3,906,660 A 9/1975 Voth ..... 46/65
3,971,158 A * 7/1976 Hanson
4,043,076 A * 8/1977 Potrzuski et al.

* cited by examiner

*Primary Examiner*—Kien T. Nguyen
(74) *Attorney, Agent, or Firm*—LaMorte & Associates P.C.

(57) ABSTRACT

A toy top system that uses uniquely configured tops. The system contains a plurality of toy tops that can be stacked on top of one another while spinning. Each of the tops has a value for rotational inertia associated with it. At least some of the tops are configured to have a value for rotational inertia that varies as a function of the rotational speed of the top. The tops with a variable rotational inertia are capable of storing and providing rotational energy while maintaining a near constant rate of rotation.

10 Claims, 3 Drawing Sheets

TOY TOP STRUCTURE AND SYSTEM

BACKGROUND OF THE INVENTION

1. Field of the Invention

In general, the present invention relates to the structure of toy tops and the manufacturing techniques used to manufacture toy tops. More particularly, the present invention relates to toys tops and similar rotating toys that having a rotational inertia that varies as a function of rotational speed.

2. Description of the Prior Art

Toy tops have been in existence for thousands of years. In the many years that tops have been in existence, they have been built in a countless number of styles, shapes and sizes. Regardless of the form of a top, all tops share certain common functional features. Tops have a central axis around which they spin. The center of gravity associated with the top passes through the central axis and the mass of the top is evenly distributed around the central axis. As the top is put into motion, the top spins about its central axis. Since the mass of the top is evenly distributed around the central axis, the top spins in a uniform manner, thereby enabling the top to be balanced at a point in line with the central axis. The top will spin in a stable manner until the rotational speed of the top falls below a certain threshold level. As the speed of the top decreases, its angular momentum decreases. Eventually, the presence of angular momentum is insufficient to overcome the forces of gravity and the top tips over.

All tops have a rotational inertia. Rotational inertia is a function of the mass of the top and the square of the distance of that mass from the central axis of rotation. As such, if two tops of the same mass are provided and one top is wider than the other, the wider top will have a larger rotational inertia than the narrower top. As rotational energy is applied to a top, the speed at which the top spins is a function of its rotational inertia. Wide tops will spin slower than narrow tops if the tops have the same mass and are spun with the same degree or rotational energy. This same principle explains why ice skaters spin faster when they draw their arms closer to their bodies. As a skater brings their arms closed to their body, their rotational inertia decreases and the speed of their rotation increases.

In recent years, top systems have been manufactured that include a series of graduated tops that can be stacked on top of one another when spinning. An early example of such a system is shown in U.S. Pat. No. 3,906,660 to Voth, entitled, Toy Top. Today, such systems typically include at least three different tops of different sizes and a spring activated launcher for spinning the tops. In such systems, each of the tops embodies a different rotational inertia since each of the tops is a different size. Furthermore, all of the tops in such systems are launched by the same spring mechanism. Accordingly, each of the tops is launched with the same initial rotational energy. However, since each of the tops has a different rotational inertia, each of the tops spins at a different speed.

When stacking spinning tops, the tops do not become stable until two contacting tops are spinning at the same rate of rotation. If two contacting tops are spinning at different rates of rotation, then the tops are rotating relative one another. This tends to make the tops wander in position and separate from one another. In prior art top systems that use multiple stacked tops, it is difficult to have all the tops spin at the same rate of rotation since each top is initially launched at a different rate of rotation. Consequently, it is difficult to stack the spinning tops in a stable configuration and have the tops remain stable for any significant amount of time. Furthermore, no top can be added to the stack that is not spinning or is spinning slowly because the non-spinning top would immediately destabilize the faster spinning tops and cause the stacked structure to fall.

A need therefore exists for an improved top structure that would enable the top to change its rotational inertia as a function of speed. Such an improved top structure would enable tops spinning at different speeds to quickly synchronize when stacked. Furthermore, stored angular momentum can be readily transferred to stationary tops or to slow moving tops when such tops are stacked on rotating tops. As such, a stationary top can be stacked upon moving tops without destabilizing the spinning structure. Such an improved top structure is provided below as defined by the following specification and claims.

SUMMARY OF THE INVENTION

The present invention is a toy top system that uses uniquely configured tops. The system contains a plurality of toy tops that can be stacked on top of one another while spinning. Each of the tops has a value of rotational inertia associated with it. At least some of the tops are configured to have a value for rotational inertia that varies as a function of the rotational speed of the top. The tops with a variable rotational inertia are capable of storing and releasing rotational energy while maintaining a near constant rate of rotation.

The tops with variable rotational inertias each contain free weights that are symmetrically disposed around its axis of rotation. The weights are biased toward the axis of rotation by a spring or by gravity. As the top spins, the weights move away from the axis of rotation against the counteracting bias. Since the mass of the weights moves away from the axis of rotation, the rotational inertia of the top changes and rotational energy is stored without altering the rate of rotation. The stored rotational energy is used to prolong the spinning time of the top and help different tops synchronize in speed when stacked.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE INVENTION

Although the present invention top can be configured in many shapes and styles, the present invention toy top is particularly well suited for use in systems of graduated tops, where the tops are designed to be stacked when spinning. Accordingly, the illustrated example of the present invention toy top will show a top system containing five graduated tops in order to set forth the best mode contemplated for the invention.

Figure 1:
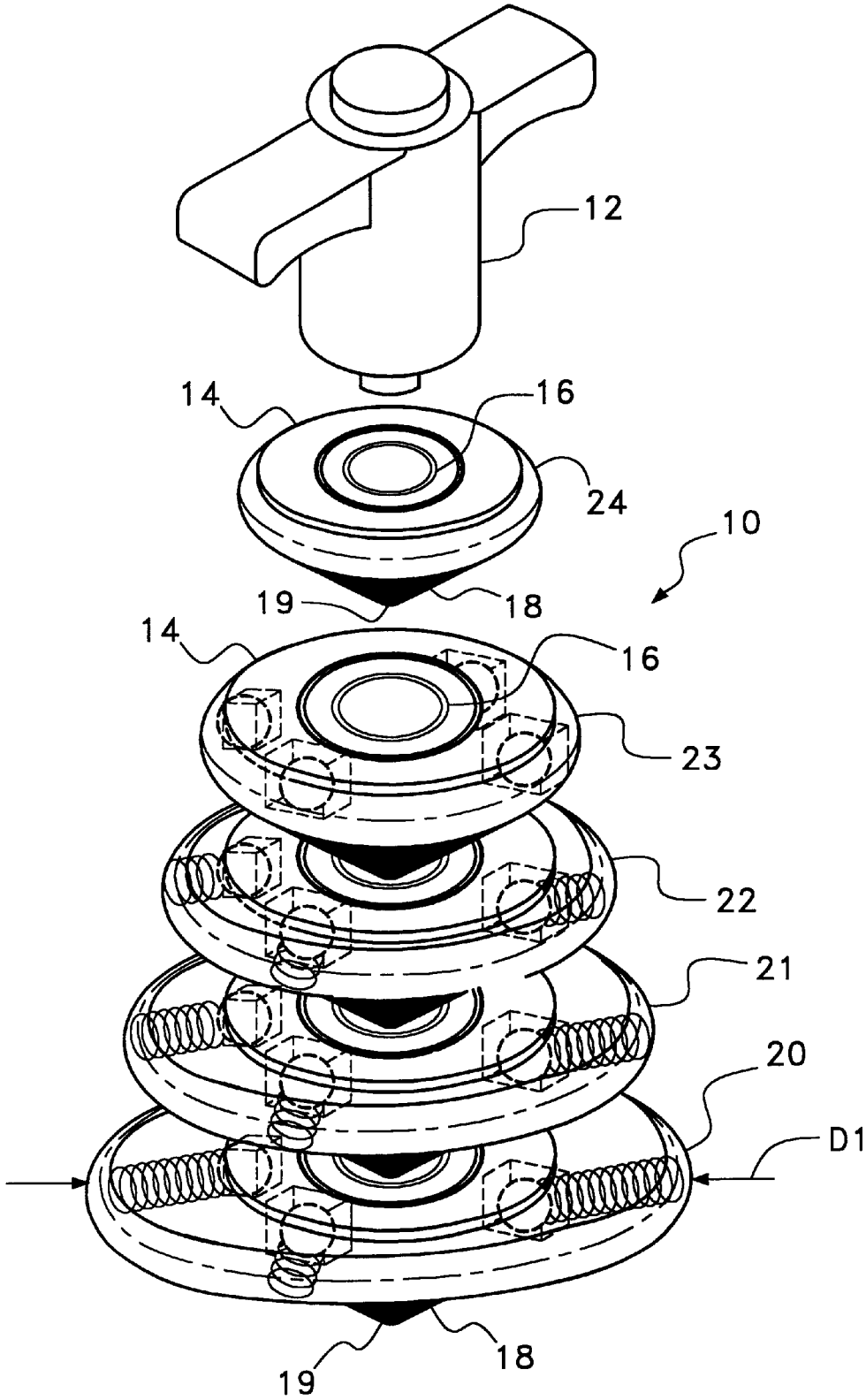
FIG. 1 is a perspective view of an exemplary embodiment of a system of toy tops in accordance with the present invention.

Referring to FIG. 1, a toy top system 10 is shown. The toy top system 10 is comprised of five tops 20, 21, 22, 23, 24 that are graduated in size. The toy top system 10 also includes a spring powered launcher 12 that is used to spin the tops. The use of five tops is merely exemplary, and it should be understood that any plurality of tops can be contained within the system.

Each of the five shown tops 20, 21, 22, 23, 24 contains a central hub 14. The hub 14 of each of the tops is identical and is sized to engage the spring powered launcher 12. Accordingly, a single spring powered launcher 12 is capable of independently engaging and spinning each of the different tops 20, 21, 22, 23, 24 in the system 10, regardless of the size of the top. The central hub 14 of each top also includes a central cylindrical projection 16. When the various tops are stacked, a top rests within the central cylindrical projection 16 of the below lying top. The cylindrical projection 16 therefore limits the movement of each of the tops when the tops are stacked. This enables all five tops 20, 21, 22, 23, 24 to be stacked on top of one another.

Each of the tops 20, 21, 22, 23, 24 has a sloped base 18. The sloped base 18 of each of the tops is identical in structure and size. At the apex of the sloped base 18 is a metal head 19. The tops rotate on their metal heads 19 when spinning on a flat surface. Although the use of a metal head 19 is optional, it is preferred because is provides a strong spinning point for the tops having a low coefficient of friction.

The largest of the tops 20 has a first diameter D1. The diameter of each of the remaining tops becomes progressively smaller. Each top spins around its central axis. The central axis of each top passes through the center of the sloped base 18 on the bottom surface of the top and the central hub 14 on the top surface of the top. Since the large tops have a mass that is distributed farther from the central axis than the smaller tops, the larger tops have greater rotational inertia than do the smaller tops.

Figure 2:
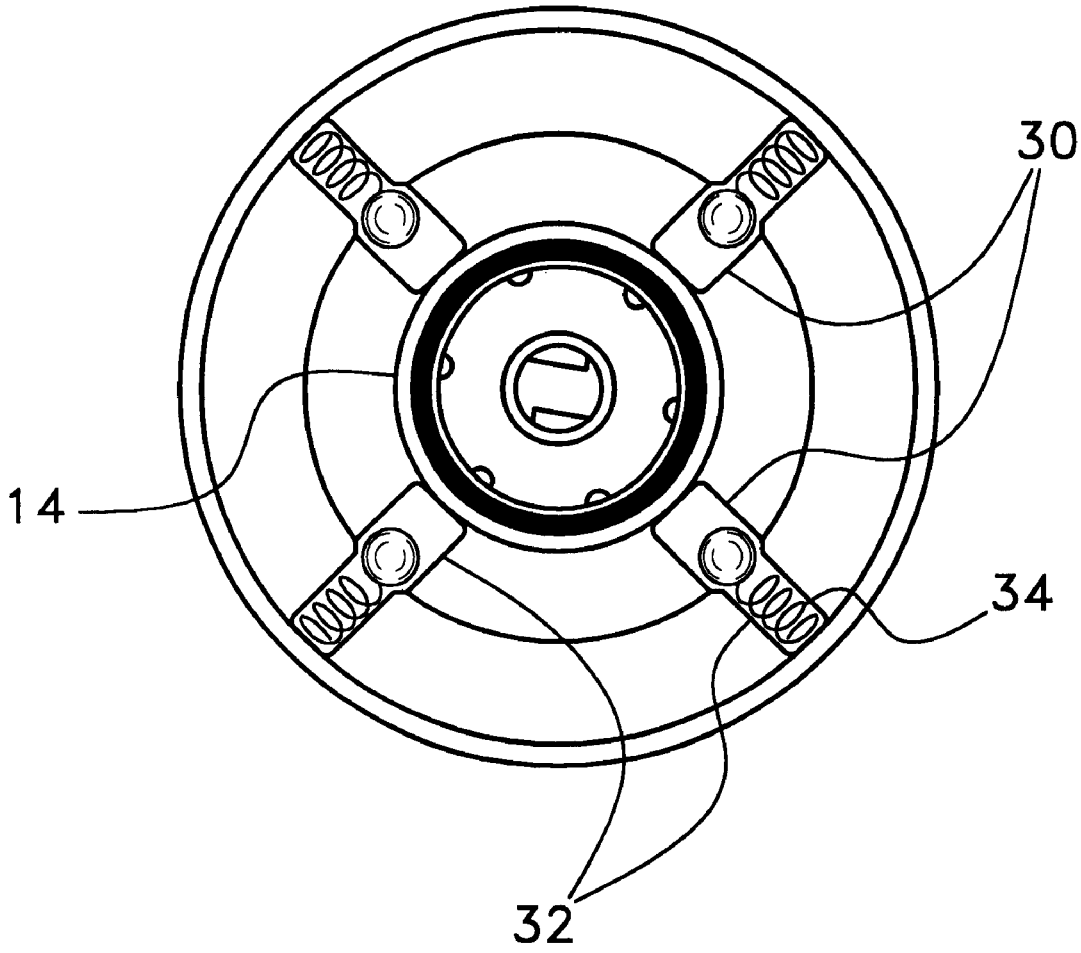
FIG. 2 is a top view of one top from the system of tops shown in FIG. 1, the top is shown in a stationary condition.

Referring to FIG. 2, a top view of the largest top 20 is shown. The structure of the largest top 20 is identical to the structure of the three largest tops 20, 21, 22 shown in FIG. 1. From FIG. 2, it can be seen that the larger tops each contain weight chambers 30 symmetrically disposed around the central hub 14 of the top. In each weight chamber 30 is a weight 32. Each weight 32 has the same mass. Accordingly, the existence of the weight chambers 30 and the weights 32 do not disrupt the balance of the top. Within each weight chamber 30, the weights 32 are biased toward the inner end of the weight chamber 30 that is nearest the central hub 14. In the larger tops, the bias to the weights can be provided by a spring 34 in the weight chamber 30. In the smaller tops, if there is no room for a spring, the bias to the weights can be provided by a sloped floor within the weight chamber, wherein gravity would bias the weight toward the inner end. A sloped weight chamber is shown as part of the fourth top 23 in FIG. 1.

In the shown embodiment of FIG. 2, a spring 34 is provided in each weight chamber 30 that biases each weight 32 toward the inner end of the weight chamber 30. When the top is at rest, the each weight 32 in each weight chamber 30 is biased against the inner end of the weight chamber 30 by the spring 34. This condition is shown in FIG. 2. However, as the top begins to spin, centripetal forces act upon the weights 32 in the weight chambers 30. The centripetal forces act to drive each weight 32 away from the inner end of the weight chamber 30 toward the outer end of the weight chamber 30.

Figure 3:
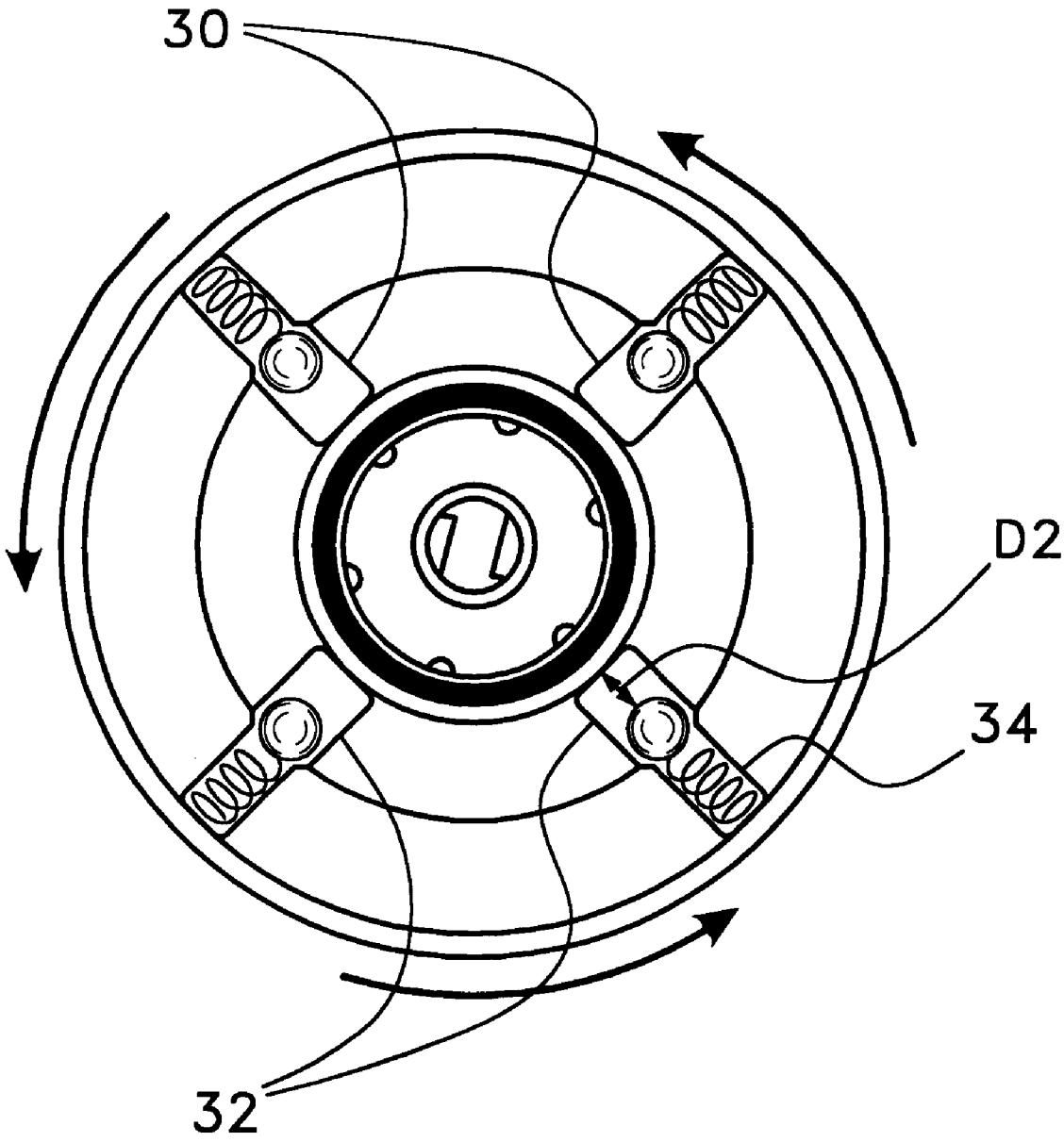
FIG. 3 is the same view as FIG. 2 with the top shown in a spinning condition.

Referring to FIG. 3, it can be seen that as the top spins, the centripetal forces pull the weights 32 against the bias of the springs 34. As a result, the weights 32 compress the springs 34 and move a distance D2 from the inner end of the weight chamber 30. The distance D2 that the weights 32 move away from the inner end of the weight chamber 30 is dependent upon the mass of the weights 32, the bias force of the springs 34 and the rotational speed of the top. The faster the top spins, the greater the centripetal forces are and the farther the weights 32 will compress the springs 34.

The top is spun by the spring loaded launcher 12 (FIG. 1). Accordingly, the initial rotational energy used to spin the top is a known value. The mass of the weights 32 and the bias of the springs 34 are calibrated so that the springs 34 are compressed when the top is first spun by the spring loaded launcher. As the top spins, it loses energy and slows down. As the top slows down, the centripetal forces decrease and the weights 32 slowly fall back toward the inner end of the weight chambers 30. When the top falls below a certain threshold rate of spin, the bias of the springs 34 surpasses the centripetal forces and the weights 32 are again biased against the inner end of the weight chambers 30.

Since the positions of the weights 32 in the weight chambers 30 change as the top spins at different speeds, the distance of the weights 32 from the top's central axis also changes. Consequently, the rotational inertia of the top varies as a function of rotational speed. Rotational inertia is expressed by the following formula:

$$I=\Sigma mr^2$$

Where I is rotational inertia, m is the mass of the spinning object and r is the distance of the mass from the axis of rotation. When the top is spinning rapidly, the weights 32 will be far from the axis of rotation and the rotational inertia will be great. When the top is spinning slowly, the weights 32 move toward the axis of rotation and the rotational inertia decreases.

The ability of the tops in the present invention system to change their rotational inertia has certain practical benefits. In an ordinary top, the rate of rotation of the top steadily decreases as the top loses energy. As such, prior art tops do not remain at one rotational rate for very long. However, with the present invention top, the rotational inertia of the top deceases as the top loses energy. As a spinning body decreases its rotational inertia, it tends to spin faster. This is evidenced by an ice skater spinning faster when the skater pulls his/her arms closer to their body. Consequently, when the present invention top is spun and energy is lost, the losses in rotational speed are balanced by the decrease in rotational inertia. As a result, the top stays at an equilibrium near a constant rate of rotation for a majority of the time in which the top spins.

The moving weights 32 in the top also act to store rotational momentum. When one top is spun, the weights 32 may be biased away from the inner end of the weight chambers 30. If a another top is placed upon the first top and the upper top is spinning slower than the lower top or is not spinning at all, the lower top transfers rotational energy to the upper top. As rotational energy is transferred from the lower top to the upper top, the upper top begins to spin. The lower top, however, loses energy. As the lower top loses energy, the weights 32 in the lower top move closer to the center of the top and the rotational speed of the lower top remains the same. It is therefore possible to make the upper top spin at the same speed as the lower top without the lower top ever slowing down.

The ability to store and transfer rotational energy makes the task of stacking tops much easier. If a first top is placed on a second top and the two tops have different rates of rotation, each top will either store or release rotational energy until the tops spin at the same rate. Consequently, by using tops that store and release rotational energy in moving weights, the ability to stack multiple tops, such as those shown in FIG. 1, becomes simpler.

It will be understood that the embodiment of the present invention system of tops that is described and illustrated herein is merely exemplary and a person skilled in the art can make many variations to the embodiment shown without departing from the scope of the present invention. All such variations, modifications and alternate embodiments are intended to be included within the scope of the present invention as defined by the appended claims.

What is claimed is:

1. A toy top, comprising:

a structure symmetrically disposed around a central axis, wherein said structure terminates at one end with a point that is located on said central axis;

a plurality of weights symmetrically disposed around said central axis, wherein each of said weights is supported by said structure;

a plurality of springs for applying a biasing force to each of said plurality of weights that bias the weights toward said central axis, wherein said weights compress said springs and move away from said central axis when the top rotates about said central axis faster than a predetermined minimum rate of rotation.

2. The top according to claim 1, wherein said structure defines a plurality of enclosed weight chambers, wherein one of said weights and one of said said springs are located in each of said weight chambers.

3. The top according to claim 2, wherein each of said weights are free moving within said enclosed weight chambers.

4. A toy top, comprising:

a plurality of weights disposed around a central axis;

a plurality of springs that bias said weights toward the central axis, wherein said weights compress said springs and move away from said central axis as said top spins, thereby providing said top with a variable value for rotational inertia that varies as a function of rate of rotation for said top.

5. The top according to claim 4, wherein the value for rotational inertia associated with said top is directly proportional to said rate of rotation.

6. The top according to claim 4, wherein said plurality of weights are symmetrically disposed around said central axis.

7. A system, comprising:

a plurality of tops, at least some of said tops having a plurality of weights disposed around a central axis, and a plurality of springs that bias said weights toward the central axis, wherein said weights compress said springs and move away from said central axis as said tops spin, thereby providing at least some of said tops with a value for rotational inertia that varies as a function of rotation rate;

a launcher selectively attachable to each of said plurality of tops, wherein said launcher is capable of spinning each of said tops with a predetermined amount of rotational energy.

8. The system according to claim 7, wherein each of said plurality of tops has a different diameter.

9. The system according to claim 7, wherein each of said tops has a top surface with a structure thereon that is capable of retaining another of said tops.

10. The system according to claim 7, wherein the value for rotational inertia associated with at least some of said tops is directly proportional to said rate of rotation for those tops.

* * * * *